US012661705B2

(12) United States Patent
Chevalley et al.

(10) Patent No.: US 12,661,705 B2
(45) Date of Patent: Jun. 23, 2026

(54) APPARATUS FOR THE PRODUCTION OF TEAR-OFF LIDS

(71) Applicant: Soudronic AG, Bergdietikon (CH)

(72) Inventors: François Chevalley, Winterthur (CH); Tobias Haas, Stallikon (CH); Patrick Jaques, Péry (CH)

(73) Assignee: SOUDRONIC AG, Bergdietikon (CH)

( * ) Notice: Subject to any disclaimer, the term of this patent is extended or adjusted under 35 U.S.C. 154(b) by 282 days.

(21) Appl. No.: 18/548,349

(22) PCT Filed: Mar. 4, 2021

(86) PCT No.: PCT/EP2021/055489
§ 371 (c)(1),
(2) Date: Aug. 30, 2023

(87) PCT Pub. No.: WO2022/184262
PCT Pub. Date: Sep. 9, 2022

(65) Prior Publication Data
US 2024/0139796 A1 May 2, 2024

(51) Int. Cl.
*B21D 51/44* (2006.01)
*B21D 43/12* (2006.01)

(52) U.S. Cl.
CPC ..... *B21D 51/443* (2013.01); *B21D 43/12* (2013.01)

(58) Field of Classification Search
CPC ..... B21D 51/44; B21D 51/443; B21D 43/12
See application file for complete search history.

(56) References Cited

U.S. PATENT DOCUMENTS

2007/0113985 A1 5/2007 Gysi et al.
2007/0258803 A1 11/2007 Gysi
2010/0035739 A1 2/2010 Gysi et al.

FOREIGN PATENT DOCUMENTS

DE 9203953 U1 7/1992
DE 29817592 U1 11/1998
(Continued)

OTHER PUBLICATIONS

International Search Report mailed on Nov. 24, 2021, in connection with corresponding International Application No. PCT/EP2021/055489 (5 pp., including machine-generated English translation).

*Primary Examiner* — Teresa M Ekiert
(74) *Attorney, Agent, or Firm* — McCormick, Paulding & Huber PLLC

(57) ABSTRACT

An apparatus (1) for the production of tear-off lids (27), in which a tear-off film (24) is sealed or glued onto the upper side thereof on a sealing surface (18) arranged around a removal opening (17). The apparatus includes a conveying device (13) for lid blanks (9), lid rings (8), and tear-off lids (27), as well as processing stations (14, 19, 21, 25, 26, 29) which are provided in succession in the conveying direction for processing the lid blanks (9), lid rings (8), and tear-off lids (27) and form a processing zone of the apparatus (1) extending in the conveying direction. At least some of the processing stations (14, 19, 21, 25, 26, 29) have lifting tables (5) for receiving lower machining tools which, in the intended operation of the apparatus (1), execute an intermittent upward and downward movement along lifting table guides (6) and, in doing so, work with the lower machining tools from below against associated upper machining tools which are supported on stationary yokes (4). According to the disclosure, the lifting table guides (6) are arranged in an area adjacent to the processing zone of the apparatus, as seen in the conveying direction, on exactly one of the two sides
(Continued)

of the processing zone. This leaves the area on the other side of the processing zone largely unobstructed and provides excellent accessibility to the processing zone for inspection purposes and maintenance work.

31 Claims, 8 Drawing Sheets

(56) References Cited

FOREIGN PATENT DOCUMENTS

| | | | |
|---|---|---|---|
| EP | 2151287 | A1 | 2/2010 |
| WO | 2006/017953 | A1 | 2/2006 |

A

APPARATUS FOR THE PRODUCTION OF TEAR-OFF LIDS

CROSS-REFERENCE TO RELATED APPLICATION

This application is a National Stage application of International Patent Application No. PCT/EP2021/055489, filed Mar. 4, 2021, the disclosure of which is incorporated herein by reference in its entirety.

TECHNICAL FIELD OF THE INVENTION

The invention relates to an apparatus for the production of tear-off lids according to the preamble of patent claim 1.

BACKGROUND OF THE INVENTION

Tear-off lids (so called Peel Off Ends or POEs) are known, for example from DE-U 298 17 592 or from DE-U 92 03 953.

With reference to the FIGS. 1 to 6, a prior art production of tear-off lids known to the skilled person can be briefly explained.

FIG. 1 shows a lid blank 9. At the beginning of the transport path of a known manufacturing apparatus 10 (see FIG. 6), a stack 11 is shown which contains a plurality of such lid blanks 9 which are individually destacked and processed along the transport path by various processing stations 14, 19, 21, 25, 26, whereby from the lid blanks 9 first lid rings 8 are formed (see FIG. 2) and these are then further processed until the finished tear-off lid 27 (see FIG. 5) is formed. The lid blanks 9 are, for example, round or oval discs made of coated metal and thus protected against corrosion, in particular of coated tinplate or aluminum sheet. They have a diameter of 11 cm, for example. These blanks 9 have already been preformed at their edge 12 by a processing machine not shown, and the formation of the edge 12 later serves to fasten the finished tear-off lid 27 to a container 28 or can, respectively, by a folded joint. This is known to the skilled person and will not be further explained here.

The conveying device 13, which conveys the lid blanks, the lid rings, and the tear-off lids in the manufacturing apparatus 10 along the transport path in the direction of arrow A from one processing station to the next processing station, is formed in particular by two toothed belts running in parallel, on which receptacles for the lid blanks or lid rings, respectively, are provided, as known to the skilled person from WO 2006/017953. This is also not explained further here. In the respective processing stations according to the prior art, which are known to the skilled person and are shown here only schematically, the blank or ring, respectively, to be processed is in each case lifted off the conveying device and processed by the processing station and returned to the conveying device. This is indicated at the processing stations by arrows pointing up and down. At the processing stations, the drive of the processing stations is indicated below the conveyor means. This is used for lifting and lowering the blanks and cover rings and for carrying out the respective processing steps.

In a punching processing station 14, a lid ring 8 is first formed from the lid blank 9 by punching out a central part 16 of the blank downward and usually discarding it as waste (see FIG. 2). This forms the removal opening 17 of the tear-off lid, which is closed with the tear-off film 24 in a later manufacturing step. A sealing flange 18 remains adjacent to the removal opening 17. In a processing station 19, the edge of the removal opening 17 is pulled upwards to form a collar 20 (see FIG. 3). In a further processing station 21, this collar 20 is rolled in towards or away from the removal opening to form a so-called "curl". This curl 22, which then forms the edge of the removal opening 17, ensures that the user of the can is protected from the sharp-edged cut edge 23 when removing the contents of the can. Depending on the extent of the curl, this is referred to as a "C-curl" (cut edge not located within the curl) or a "retort curl" (cut edge located within the curl), and "curls" which are curled away from the removal opening are referred to as a "reverse C-curl" or a "reverse retort curl", respectively. In the case shown here, a so-called retort curl 22 is formed (see FIG. 4).

The previous manufacturing steps have been carried out in a position in which the lid blanks 9 and lid rings 8 were arranged with their later upper side or with the sealing flange 18, respectively, facing downward. This is a preferred embodiment, also in the present invention. As mentioned, the blank 9 or ring 8, respectively, is lifted from the conveying device 13 in the individual processing stations 14, 19 and 21, processed and placed back again, whereupon the conveying device carries out conveying steps which guide the lid blanks 9 or lid rings 8, respectively, to the next processing station. If, as shown, the manufacturing steps are carried out with the sealing flange 18 pointing downwards, this is now followed by a turning station 23 which turns the lid rings 8, so that, during further processing, the sealing flange 18 is at the top after the turning station 23 in the conveying device 13 and in the processing stations 25, 26.

The tear-off film 24 is then sealed onto the sealing flange 18, which can be done in two stages with a pre-sealing station 25 and a main sealing station 26. The sealing process is also known to the person skilled in the art and is not explained further here. Further processing stations can follow, in which embossing of the sealing film 24 takes place, the tear tab 15 is positioned and a leak test is carried out. This is also known to the skilled person and will not be explained further here. At the end of the known manufacturing apparatus 10, finished tear-off lids 27 are dispensed (see FIG. 5), the removal opening 17 of which is spanned by a tear-off film 24 which is sealed to the sealing flange 18. The edge of the removal opening 17 is formed here by the retort curl 22. The finished tear-off lid 27 can be fastened by means of its seamed edge 12 to a can body (which is indicated in FIG. 5 only by a wall part 28) and thus seals the can. This is done in the filling facility, in which the can has been filled with a filling material. The filled can be opened later by tearing the tear-off foil 24 away from the lid ring 8 by means of its tear-off tab 15, thereby exposing the removal opening 17.

The manufacturing apparatuses 10 for the tear-off lids can be of single-lane or multi-lane design, and can be designed as linear or rotary machines. A so far unsolved problem is the poor accessibility of the processing zone for maintenance work, which is why the machines known today must be accessible from both sides.

SUMMARY

The invention is based on the objective of providing an apparatus for the production of tear-off lids in which the processing zone is significantly more accessible for maintenance work than in the case of the generic apparatuses known today.

This task is solved by the apparatus according to patent claim 1.

According to this, the invention relates to an apparatus for the production of tear-off lids, in which a tear-off film is sealed or glued to the upper side of the lid on a sealing surface arranged around a removal opening. The apparatus, often also referred to as a "sealing machine", comprises a conveying device for lid blanks, lid rings, and tear-off lids as well as processing stations which are provided in succession in the conveying direction for processing the lid blanks, lid rings, and tear-off lids and form a processing zone of the apparatus extending in the conveying direction. At least some of the processing stations have lifting tables for receiving lower machining tools which, in the intended operation of the apparatus, execute an intermittent upward and downward movement along lifting table guides and, in doing so, work with the lower machining tools from below against associated upper machining tools which are supported on fixed yokes.

According to the invention, the lifting table guides are arranged in an area adjacent to the processing zone of the apparatus, viewed in the conveying direction, on exactly one of the two sides of the processing zone.

This leaves the area on the other side of the processing zone largely unobstructed, and provides excellent accessibility to the processing zone for inspection purposes and maintenance work.

Preferably, the apparatus is also designed in such a way that at least part of the yokes can be displaced for maintenance purposes along yoke guides which, viewed in the conveying direction, are arranged in an area adjacent to the processing zone of the apparatus.

Thereby, it is further preferred that the yoke guides are arranged on exactly one of the two sides of the processing zone, advantageously on the side on which the lifting table guides are also arranged. This allows the yokes to be moved along guides for maintenance or inspection purposes without impairing accessibility.

In the latter case, it is further preferred that the lifting table guides and the yoke guides are at least partially formed as common lifting table-yoke guides.

It is particularly preferred that all yoke guides are designed as common lifting table-yoke guides.

This saves costs and installation space.

With an advantage, the processing stations of the apparatus according to the invention are arranged on a common, preferably indivisible machine frame. In this way, the assembly, testing and commissioning of the apparatus is significantly simplified. The station modules can be aligned with each other already in the factory.

Thereby, it is preferred that the machine frame has an essentially L-shaped or T-shaped cross-section when viewed in the conveying direction, with a horizontal base plate and a center wall or rear wall rising perpendicularly therefrom, which forms part of the support structure of the machine frame. This center or rear wall is then suitable for assuming supporting and positioning functions.

Accordingly, in a preferred embodiment of such an apparatus according to the invention, it is provided that the lifting table guides and, advantageously, also the yoke guides are fixed to the center wall or rear wall.

In another preferred embodiment, the apparatus has a linear processing zone, i.e. it is designed as a linear machine, and is preferably of single-lane design.

In the case that the processing stations of the apparatus according to the invention are arranged on a common machine frame which, viewed in the conveying direction, has an essentially L-shaped or T-shaped cross-section, it is further preferred that the apparatus comprises a control cabinet which is arranged on the side of the center wall or rear wall facing away from the processing stations. This control cabinet can already be permanently installed and wired on the machine frame in the factory, which saves an enormous amount of time during installation, testing, shipping and commissioning.

In another preferred embodiment, each lifting table is assigned to exactly one lower machining tool.

It is also preferred that at least some of the lower machining tools are fastened to the respective lifting table with quick-release fastening systems, in particular with a zero-point clamping system. Such clamping systems are offered, for example, under the product name "ROEMHELD SPEEDY metec" by the company STARK Spannsysteme GmbH in Austria.

This makes the tool change much easier.

In yet another preferred embodiment, at least some of the yokes are assigned to several lifting tables. In this way, the technical complexity required can be reduced and accessibility further improved.

In still another preferred embodiment, the apparatus according to the invention comprises individual processing stations for the processing steps of punching, drawing, rolling, pre-sealing, main sealing and embossing.

Thereby, it is advantageous that the lifting tables of the processing stations for the drawing and rolling processing steps and/or the lifting tables of the processing stations for the pre-sealing and main sealing processing steps each work against a common yoke.

It is also advantageous thereby that the lifting table of the processing station for the punching processing step and/or the lifting table of the processing station for the embossing processing step each work against their own yoke assigned only to this lifting table.

In addition, it is also preferred thereby that the lifting tables of the processing stations for the punching, drawing and rolling processing steps and/or the lifting tables of the processing stations for the main sealing and embossing processing steps each have a common drive, in particular using a common servo motor.

Furthermore, it is also advantageous that the lifting table of the processing station for the pre-sealing processing step has its own drive, in particular using its own servo motor. With these aforementioned measures, it is possible to reduce the technical complexity of the system and further improve accessibility without having to accept losses in manufacturing precision.

BRIEF DESCRIPTION OF THE DRAWINGS

Further embodiments, advantages and applications of the invention are apparent from the dependent claims and from the now following description with reference to the figures.

Thereby show.

DESCRIPTION OF THE PREFERRED EMBODIMENTS

In the background section, with reference to FIGS. 1 to 6, the manufacturing of tear-off lids 27 according to the prior art known to the skilled person has been explained. Reference is made herein to this explanation in order to avoid repetition.

Figures 1, 2, 3, 4, 5, 6:
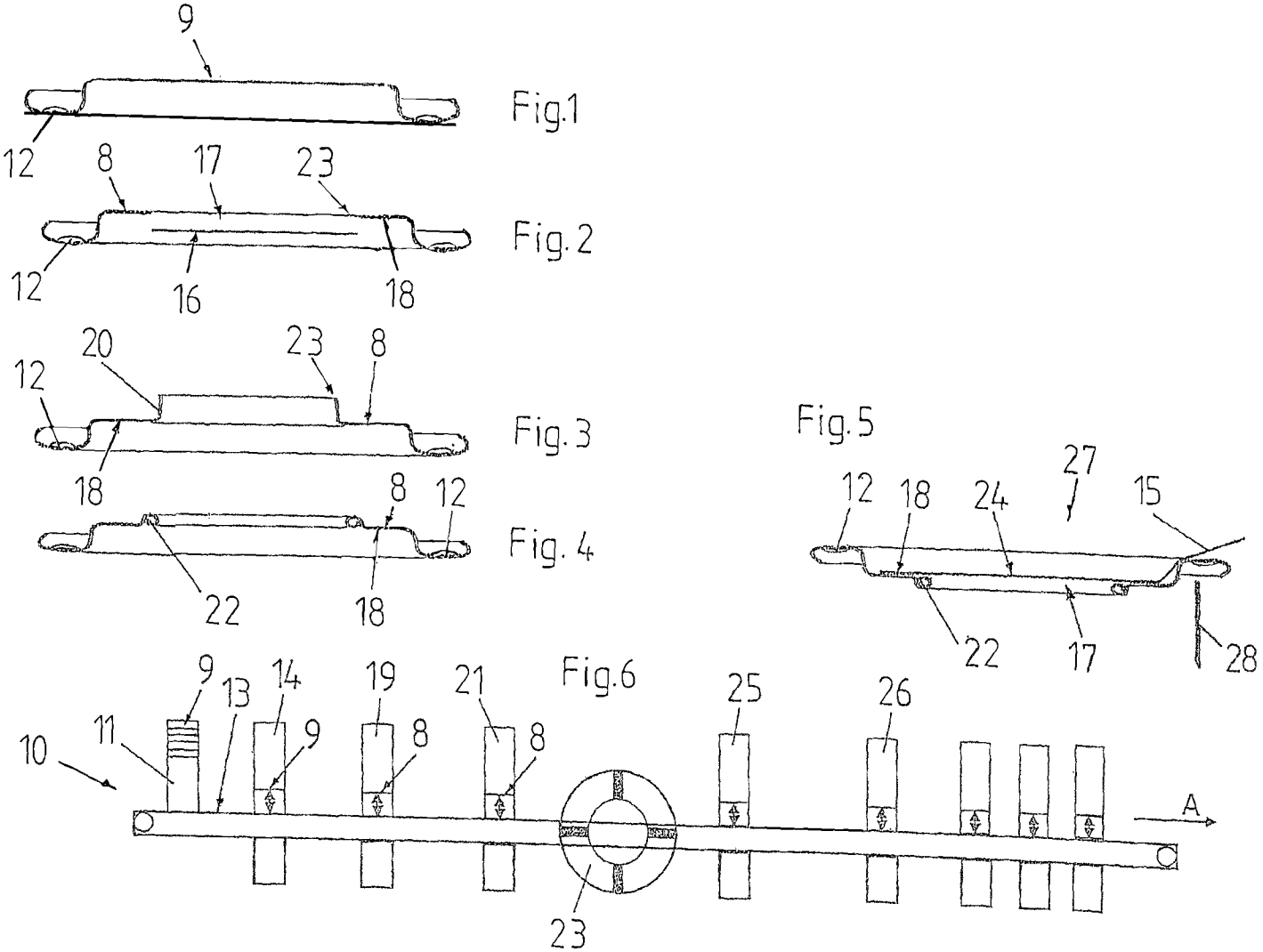
FIG. 1 is a vertical section through a lid blank 9.
FIGS. 2 to 4 show vertical sections through a cover ring 8 at various stages of production.
FIG. 5 is a vertical section through a completed tear-off lid 27.
FIG. 6 is a schematic side view of a prior art apparatus for the production of tear-off lids or for carrying out the steps according to FIGS. 1 to 5, respectively.
Figure 7:
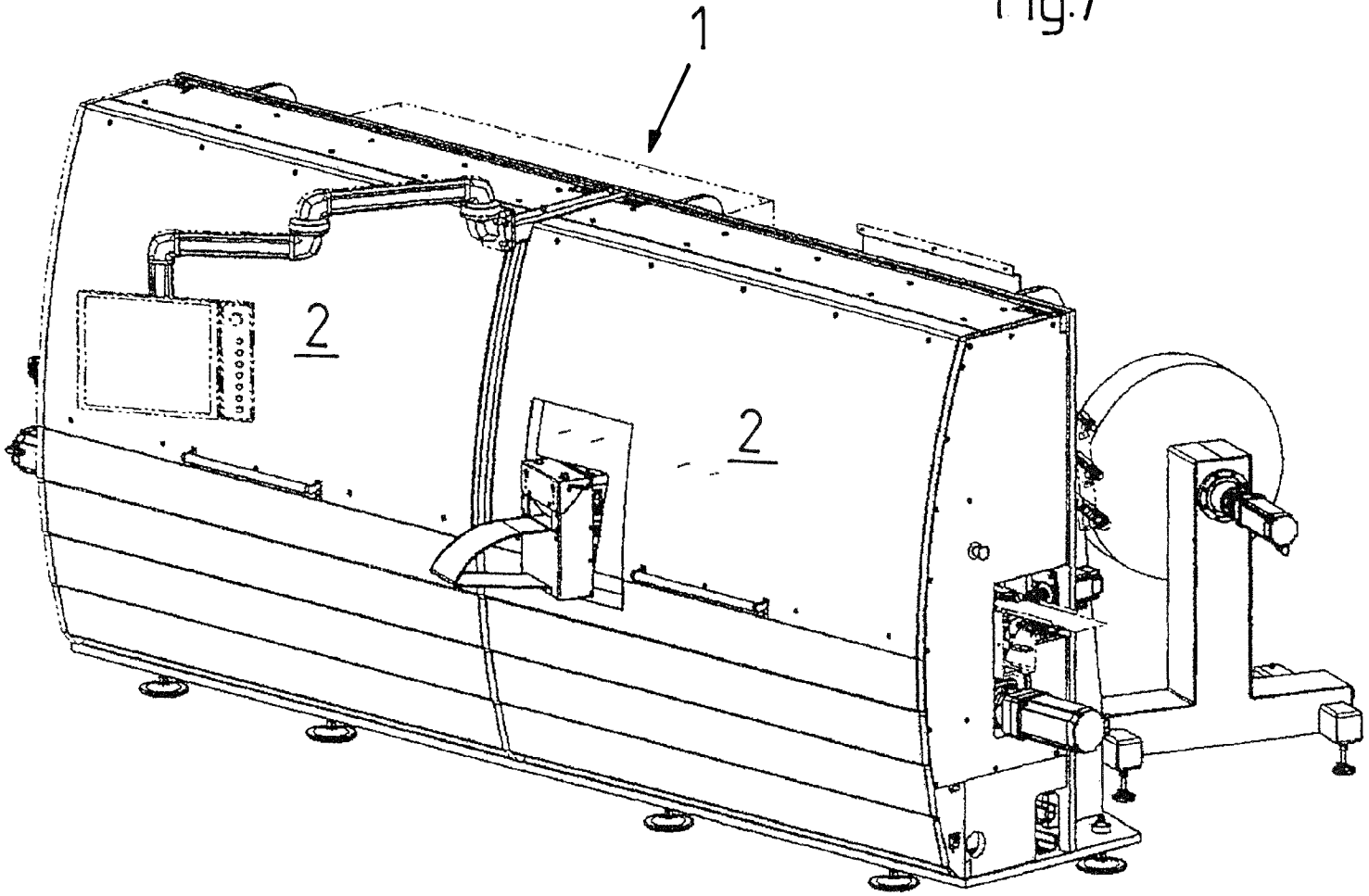
FIG. 7 is a perspective view of the operator side of an apparatus according to the invention for the production of tear-off lids.

FIG. 7 shows a perspective view of the operator side of an apparatus 1 according to the invention for producing tear-off lids 27, in which a tear-off film 24 is sealed or glued onto a sealing surface 8 arranged around a removal opening 17 on the upper side thereof. As can be seen, the processing zone of the apparatus 1 is completely covered and separated from the surroundings on the operator side by two upwardly pivoting doors 2 with glass fronts.

Figure 8:
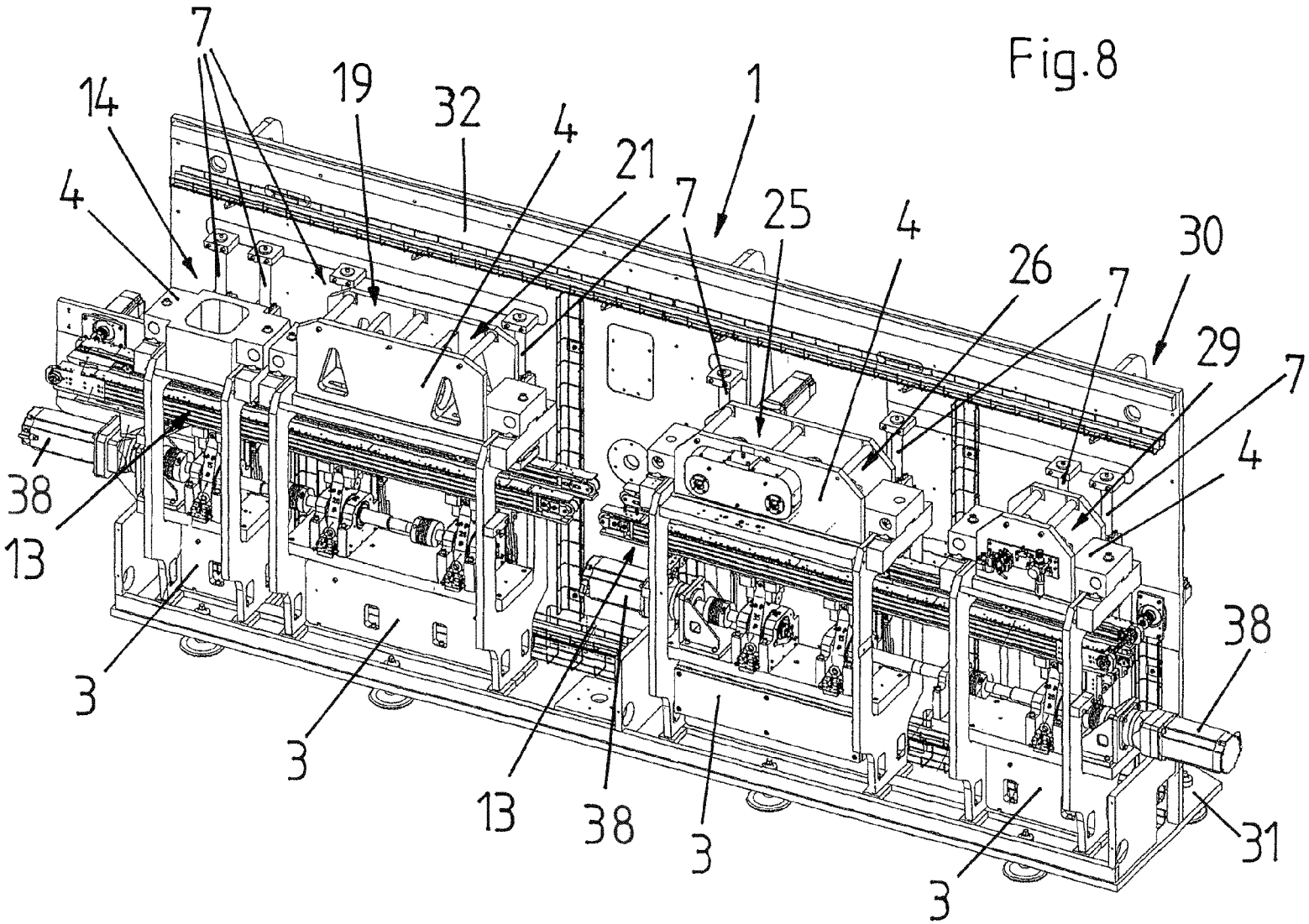
FIG. 8 is a perspective view of the apparatus of FIG. 7 with the panels removed.

FIG. 8 shows a perspective view of the apparatus 1 of FIG. 7 with the panels and doors 2 removed. As can be seen, the apparatus is of single-lane design and comprises a conveying device 13 for lid blanks 9, lid rings 8, and tear-off lids 27 as well as processing stations 14, 21, 25, 26, 29, which are provided in succession in the conveying direction (from left to right) for processing the lid blanks 9, lid rings 8, and tear-off lids 27 and form a linear processing zone of the apparatus extending in the conveying direction. The turning station is not shown.

Figure 9:
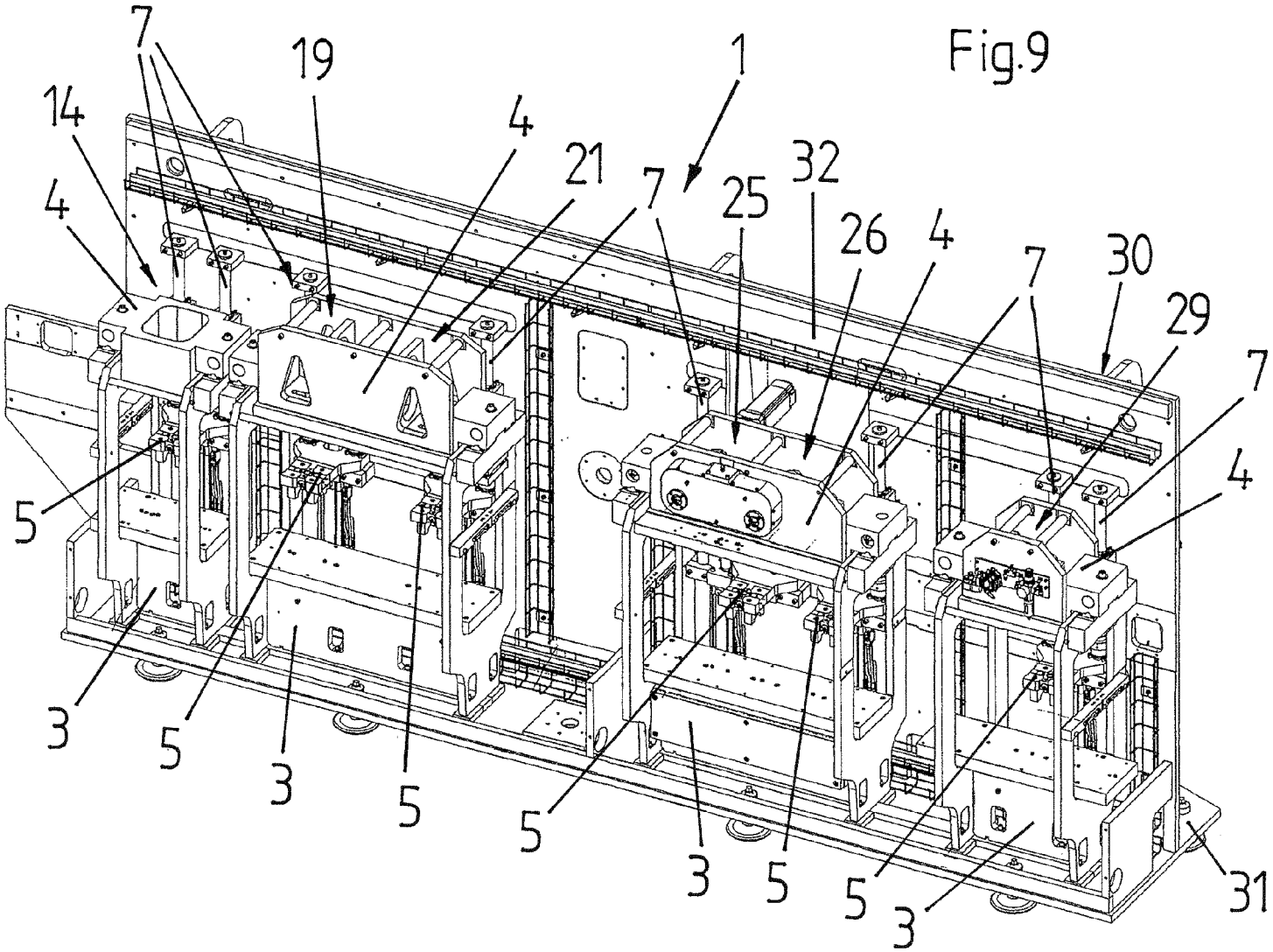
FIG. 9 is an illustration like FIG. 8 with additionally removed conveying devices.

As can be seen in synopsis with FIG. 9, which shows a representation like FIG. 8 but with the conveying devices 13 and the station drives removed, the processing stations 14, 21, 25, 26, 29 are formed in station frames 3 with yokes 4 and have lifting tables 5 for receiving the lower machining tools (not shown). Thereby, each lifting table 5 is assigned to exactly one lower machining tool, which is fastened to the respective lifting table with quick-release fastening systems. The processing stations 14 and 29 each have their own yoke 4. The processing stations 19 and 21 and 25 and 26 each share a common yoke 4.

As can be seen in further synopsis with FIG. 10, which shows a representation like FIG. 9, but in which the station frames 3 with the yokes 4 are additionally removed, the lifting tables 5 are provided with lifting table guides 6, along which they perform an intermittent upward and downward movement during the intended operation of the apparatus, and thereby work with the lower machining tools from below against associated upper machining tools (also not shown), which are supported on fixed yokes 4.

The yokes 4 are provided with yoke guides 7 along which they can be moved for maintenance purposes. They are fastened to the station frames 3 with quick-release fastening systems.

The lifting table guides 6 and the yoke guides 7 are here completely or partially formed as common lifting table-yoke guides 6, 7 and, viewed in the conveying direction (from left to right), are arranged in an area adjacent to the processing zone of the apparatus, namely on the side of the processing zone facing away from the operator side.

As can be further seen, the processing stations 14, 21, 25, 26, 29 are arranged on a common, indivisible machine frame 30, which has a substantially T-shaped cross-section as viewed in the direction of conveyance, with a horizontal base plate 31 and a center wall 32 rising perpendicularly therefrom, which forms part of the support structure of the machine frame 30. The lifting table guides 6 and the yoke guides 7 are attached to the center wall 32.

Figure 12:
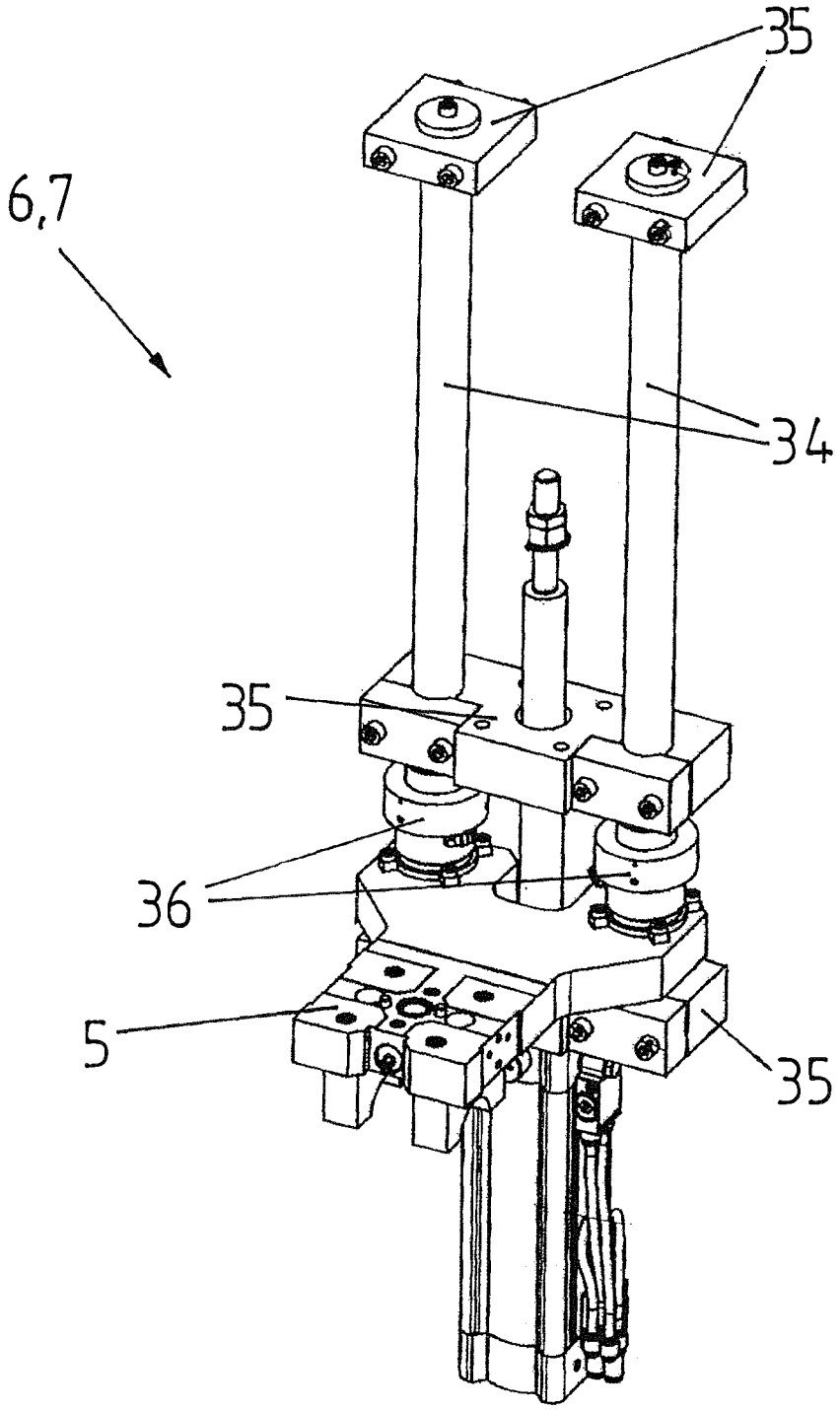
FIG. 12 is a perspective view of the combined lifting table and yoke guide of the punching station of the apparatus of FIGS. 7 to 11.

FIG. 12 shows a perspective view of the combined lifting table and yoke guides 6, 7 of the punching station 14 and the embossing station 29. As can be seen, these guides 6, 7 each have two long guide rods 34, which are fastened to the center wall 32 by fastening bodies 35. The guide bushings 36 of the lifting table 5 run on the lower part of the guide rods 34, and the guide bushings of the yoke (not shown) run on the upper part of the guide rods 34, which is exposed in the illustration.

Figure 13:
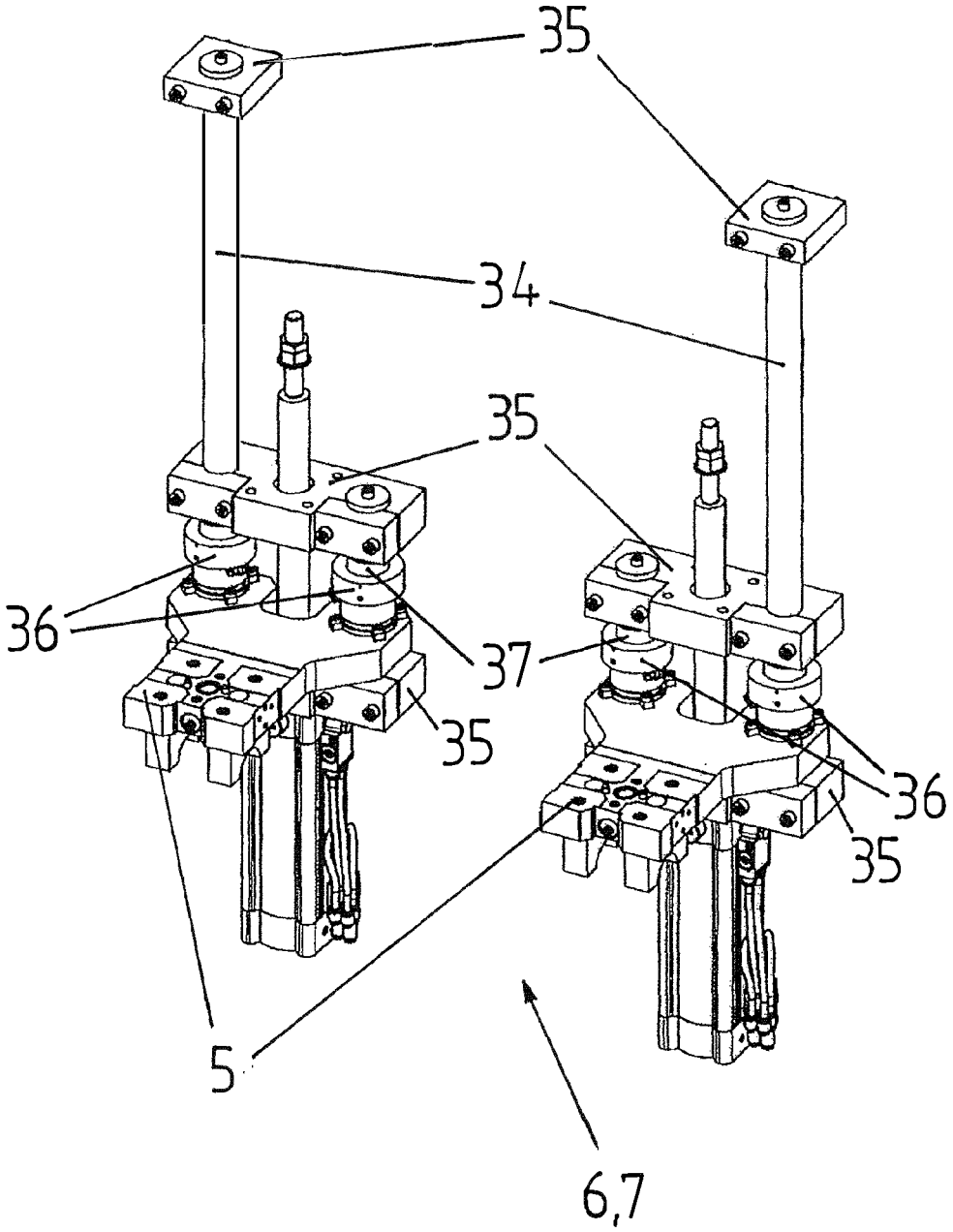
FIG. 13 is a perspective view of the combined lifting table and yoke guides of the drawing station and the rolling station of the apparatus from FIGS. 7 to 11.

FIG. 13 shows a perspective view of the combined lifting table and yoke guides 6, 7 of the drawing station 19 and the rolling station 21. As can be seen, these guides 6, 7 together have two long guide rods 34 and two short guide rods 37, which are fastened to the center wall 32 by fastening bodies 35. On the lower part of the long guide rods 34 as well as on the short guide rods 37 run the guide bushings 36 of the two lifting tables 5, and on the upper part of the long guide rods 34, which is exposed in the illustration, run the guide bushings of the common yoke (not shown).

Figure 10:
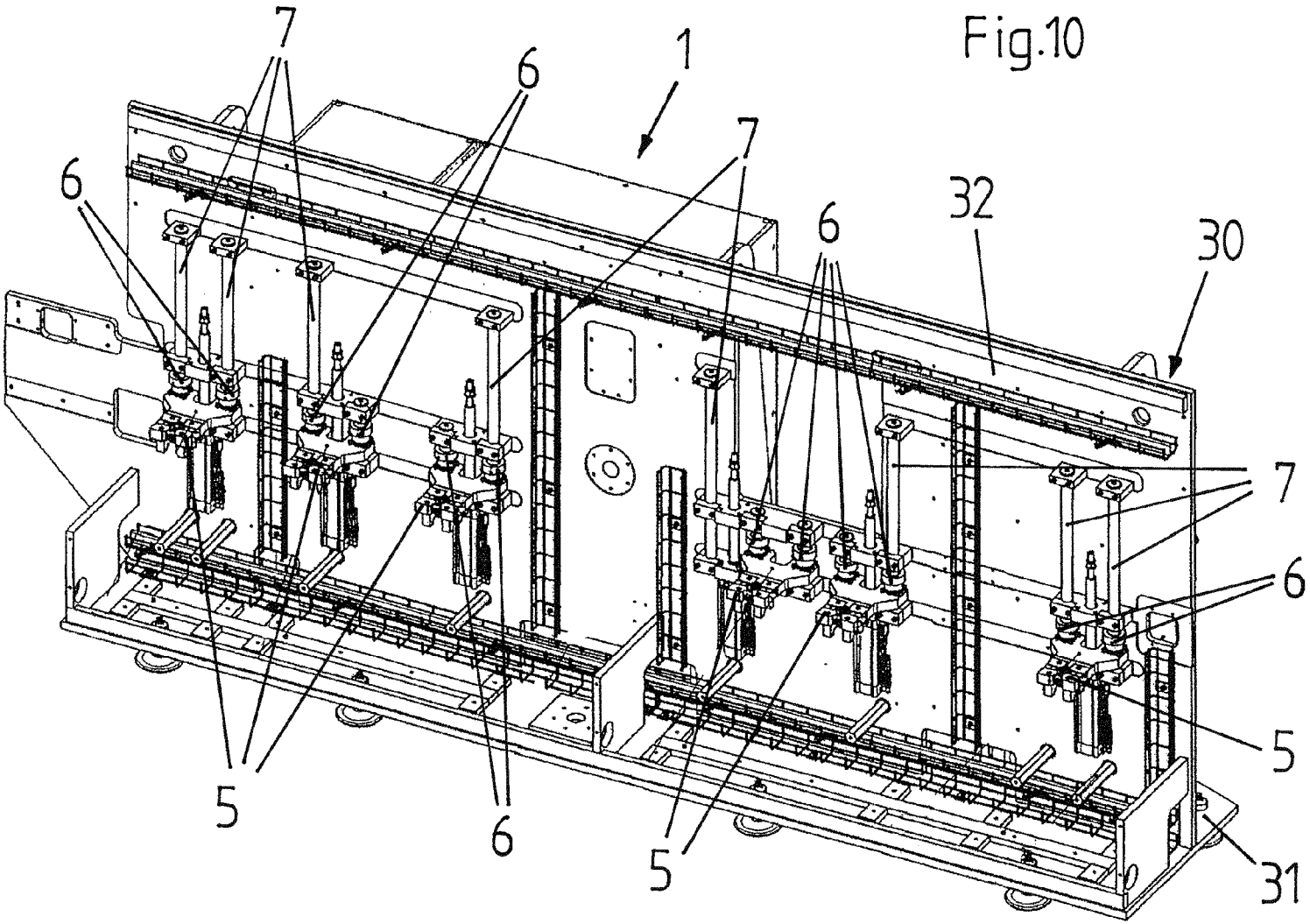
FIG. 10 is an illustration like FIG. 9 with additionally removed station frames.
Figure 11:
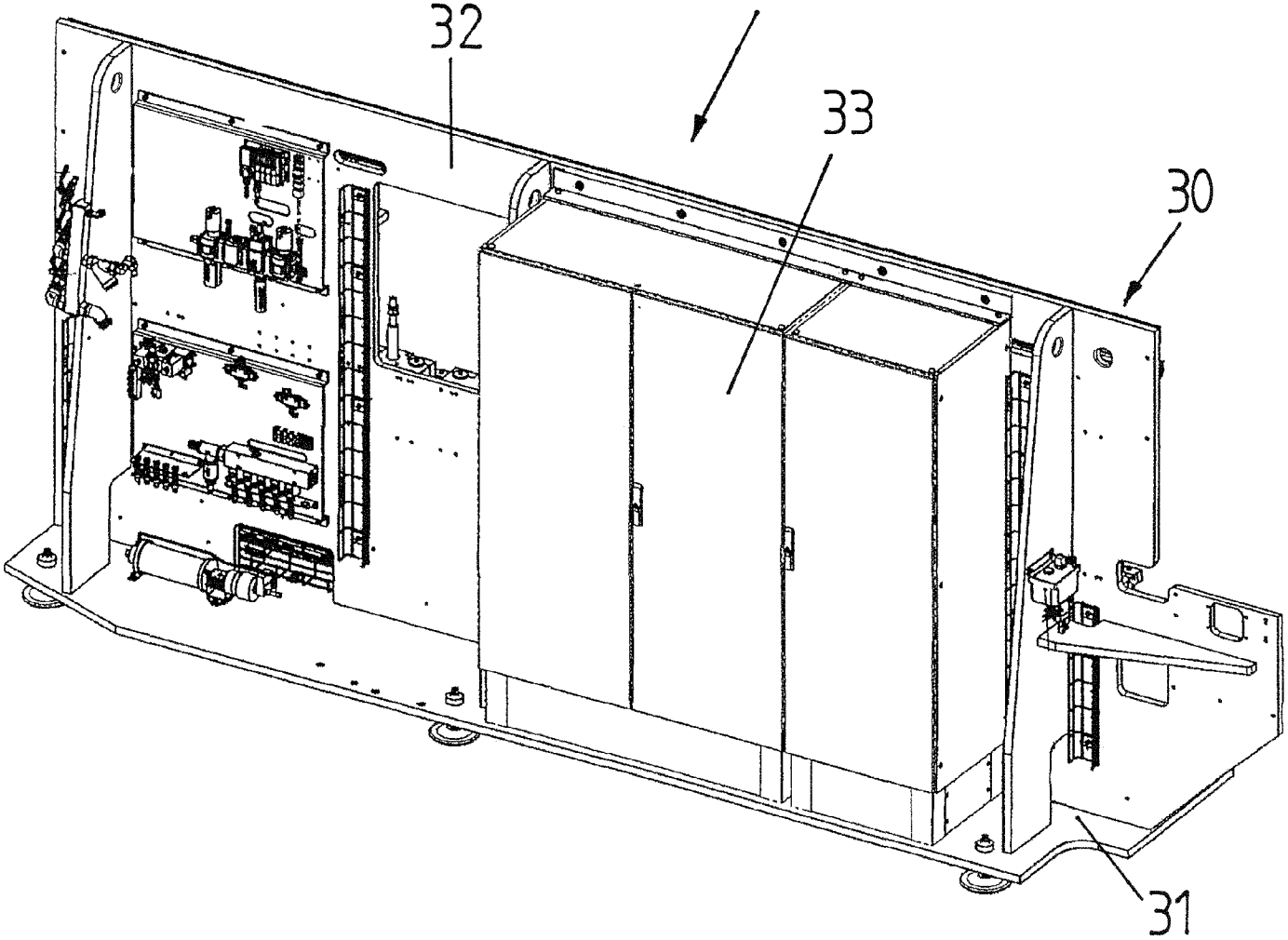
FIG. 11 is a perspective view of the rear of the apparatus of FIG. 10.

As can be seen from FIG. 11, which shows a perspective view of the rear of the apparatus of FIG. 10, the apparatus comprises a control cabinet 33, which is arranged on the side of the center wall 32 facing away from the processing stations 14, 19, 21, 25, 26, 29.

The processing stations 14, 19, 21, 25, 26, 29 perform the following processing steps: Punching (processing station 14), drawing (processing station 19), rolling (processing station 21), pre-sealing (processing station 25), main sealing (processing station 26) and embossing (processing station 29).

The lifting tables 5 of the processing stations 19 and 21 for the drawing and rolling processing steps and/or the lifting tables 5 of the processing stations 25 and 26 for the pre-sealing and main sealing processing steps each work against a common yoke 4.

The lifting table 5 of the processing station 14 for the punching processing step and the lifting table 5 of the processing station 29 for the embossing processing step each work against their own yoke 4 assigned only to this lifting table 5.

As can be seen from FIG. 8, the lifting tables 5 of the processing stations 14, 19 and 21 for the punching, drawing and rolling processing steps and the lifting tables 5 of the processing stations 26 and 29 for the main sealing and embossing processing steps each have a common drive with a common servo motor 38, while the lifting table 5 of the processing station 25 for the pre-sealing processing step has its own drive with servo motor 38.

While preferred embodiments of the invention are described in the present application, it should be clearly noted that the invention is not limited to these and may be carried out in other ways within the scope of the following claims.

What is claimed is:

1. An apparatus for the production of tear-off lids, in which a tear-off film is sealed or glued onto the upper side thereof on a sealing surface arranged around a removal opening, comprising a conveying device for lid blanks, lid rings and tear-off lids as well as processing stations which are provided in succession in the conveying direction for processing the lid blanks, lid rings, and tear-off lids and form a processing zone of the apparatus extending in the conveying direction, wherein at least some of the processing stations have lifting tables for receiving lower machining tools, the lifting tables being configured to, during operation of the apparatus, execute an intermittent upward and downward movement along lifting table guides of the apparatus and, in so doing, work with the lower machining tools from below against associated upper machining tools which are supported on stationary yokes, wherein the lifting table guides are arranged in an area adjacent to the processing zone of the apparatus, on exactly one of the two sides of the processing zone, as seen in the conveying direction.

2. The apparatus according to claim 1, wherein at least a part of the yokes can be displaced for maintenance purposes along yoke guides, which are arranged in an area adjacent to the processing zone of the apparatus as seen in the conveying direction.

3. The apparatus according to claim 2, wherein the yoke guides are arranged on exactly one of the two sides of the processing zone.

4. The apparatus according to claim 3, wherein the lifting table guides and the yoke guides are at least partially formed as lifting table-yoke guides.

5. The apparatus according to claim 4, wherein all yoke guides are formed as lifting table-yoke guides.

6. The apparatus according to claim 3, wherein the yoke guides are arranged on the side of the processing zone on which the lifting table guides are arranged.

7. The apparatus according to claim 2, wherein the lifting table guides are fastened to the center wall or rear wall.

8. The apparatus according to claim 7, wherein the yoke guides are fastened to the center wall or the rear wall.

9. The apparatus according to claim 1, wherein the processing stations are arranged on a machine frame.

10. The apparatus according to claim 9, wherein the machine frame has a substantially L-shaped or T-shaped cross-section as seen in the conveying direction, with a horizontal base plate and a center wall or rear wall rising perpendicularly therefrom, which forms part of a support structure of the machine frame.

11. The apparatus according to claim 10, wherein the apparatus comprises a control cabinet which is arranged on the side of the center wall or rear wall facing away from the processing stations.

12. The apparatus according to claim 11, wherein the apparatus comprises a linear processing zone, and wherein the apparatus comprises a control cabinet which is arranged on the side of the center wall or rear wall facing away from the processing stations.

13. The apparatus according to claim 1, wherein the apparatus comprises a linear processing zone.

14. The apparatus according to claim 13, wherein the apparatus comprises a control cabinet which is arranged on a side of a center wall or rear wall facing away from the processing stations.

15. The apparatus according to claim 13, wherein the apparatus is of single-lane design.

16. The apparatus according to claim 1, wherein each lifting table is assigned to exactly one lower machining tool.

17. The apparatus according to claim 1, wherein at least a part of the lower machining tools is fastened to the respective lifting table with quick-release fastening systems.

18. The apparatus according to claim 1, wherein at least a part of the yokes can be displaced along yoke guides for maintenance purposes, and at least a part of these yokes is fastened with quick-release fastening systems.

19. The apparatus according to claim 1, wherein at least a part of the yokes is assigned to several lifting tables.

20. The apparatus according to claim 19, wherein the lifting tables of the processing stations for the processing steps drawing and rolling and/or the lifting tables of the processing stations for the processing steps pre-sealing and main sealing each operate against a yoke.

21. The apparatus according to claim 20, comprising individual processing stations for the following processing steps: punching, drawing, rolling, pre-sealing, main sealing, embossing, and wherein the lifting tables of the processing stations—for the processing steps drawing and rolling and/or the lifting tables of the processing stations for the processing steps pre-sealing and main sealing each operate against a yoke.

22. The apparatus according to claim 1, comprising individual processing stations for the following processing steps: punching, drawing, rolling, pre-sealing, main sealing, embossing.

23. The apparatus according to claim 22, wherein the lifting table of the processing station for the processing step punching and/or the lifting table of the processing station for the processing step embossing each operates against its own yoke assigned only to this lifting table.

24. The apparatus according to claim 22, wherein the lifting tables of the processing stations for the processing steps punching, drawing and rolling and/or the lifting tables of the processing stations for the processing steps main sealing and embossing each have a drive.

25. The apparatus according to claim 22, wherein the lifting table of the processing station for the processing step pre-sealing has its own drive.

26. The apparatus according to claim 22, wherein the lifting tables of the processing stations—for the processing steps drawing and rolling and/or the lifting tables of the processing stations for the processing steps pre-sealing and main sealing each operate against a yoke.

27. The apparatus according to claim 1, wherein the processing stations are arranged on an indivisible machine frame.

28. The apparatus according to claim 1, wherein at least a part of the lower machining tools is fastened to the respective lifting table with zero-point clamping systems.

29. The apparatus according to claim 1, wherein at least a part of the yokes can be displaced along yoke guides for maintenance purposes, and at least a part of these yokes is fastened with zero-point clamping systems.

30. The apparatus according to claim 1, wherein the lifting tables of the processing stations for the processing steps punching, drawing and rolling and/or the lifting tables of the processing stations for the processing steps main sealing and embossing each have a servo motor.

31. The apparatus according to claim 1, wherein the lifting table of the processing station for the processing step pre-sealing has its own servo motor.

* * * * *